US009425564B2

(12) United States Patent
Yamaguchi et al.

(10) Patent No.: US 9,425,564 B2
(45) Date of Patent: Aug. 23, 2016

(54) CONNECTOR

(71) Applicants: HIROSE ELECTRIC CO., LTD., Tokyo (JP); TOYOTA JIDOSHA KABUSHIKI KAISHA, Toyota-shi, Aichi-ken (JP)

(72) Inventors: Masahiko Yamaguchi, Yokohama (JP); Takuma Sawaya, Nagoya (JP)

(73) Assignees: HIROSE ELECTRIC CO., LTD., Tokyo (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 14/621,975

(22) Filed: Feb. 13, 2015

(65) Prior Publication Data

US 2015/0244115 A1 Aug. 27, 2015

(30) Foreign Application Priority Data

Feb. 27, 2014 (JP) ..... 2014-036778

(51) Int. Cl.

| | |
|---|---|
| ***H01R 9/05*** | (2006.01) |
| ***H01R 24/38*** | (2011.01) |
| ***H01R 13/6581*** | (2011.01) |
| ***H01R 13/6585*** | (2011.01) |
| ***H01R 13/6592*** | (2011.01) |
| ***H01R 24/40*** | (2011.01) |

(52) U.S. Cl.

CPC ..... *H01R 24/38* (2013.01); *H01R 13/6581* (2013.01); *H01R 13/6585* (2013.01); *H01R 13/6592* (2013.01); *H01R 24/40* (2013.01); *H01R 9/05* (2013.01)

(58) Field of Classification Search

CPC ..... H01R 9/05; H01R 9/0527; H01R 12/775; H01R 9/0506

See application file for complete search history.

(56) References Cited

U.S. PATENT DOCUMENTS 6,830,478 B1 * 12/2004 Ko ..... H01R 13/6275 439/484
7,377,803 B2 * 5/2008 Matsuoka ..... H01R 12/592 439/497

(Continued)

FOREIGN PATENT DOCUMENTS

CN 102117975 A 7/2011
JP 1993-029042 A 2/1993

(Continued)

OTHER PUBLICATIONS

Jun. 24, 2016 Office Action issued in German Patent Application No. 10 2015 102 730.5.

*Primary Examiner* — Gary Paumen
(74) *Attorney, Agent, or Firm* — Oliff PLC

(57) ABSTRACT

A connector including: multiple coaxial terminals each of which is formed into a shape of L, and has a connecting part attached to a coaxial cable and a terminal part bent with respect to the connecting part; a housing including a housing body having storage parts storing the coaxial terminals arrayed side by side and a cover closing the respective storage parts of the housing body; and a radio wave absorbing member disposed between the coaxial terminals stored in the respective storage parts and the cover and extending over the coaxial terminals, wherein the radio wave absorbing member is disposed so as to face at least a bent part in which the terminal part is bent with respect to the connecting part of each of the coaxial terminals, and provided in contact with or in proximity to each of the coaxial terminals.

4 Claims, 9 Drawing Sheets

(56) References Cited

U.S. PATENT DOCUMENTS

| | | | | |
|---|---|---|---|---|
| 7,553,167 | B2 * | 6/2009 | Zhang | H01R 4/2433 439/497 |
| 7,585,184 | B2 * | 9/2009 | Su | H01R 27/02 439/579 |
| 7,878,850 | B2 * | 2/2011 | Wu | H01R 13/6581 439/497 |
| 7,946,882 | B2 * | 5/2011 | Wu | H01R 13/648 439/108 |
| 8,043,114 | B2 * | 10/2011 | Kaneko | H01R 13/65802 439/468 |
| 8,317,523 | B2 | 11/2012 | Blakborn et al. | |
| 2004/0127099 | A1 | 7/2004 | Lin et al. | |
| 2006/0014428 | A1 | 1/2006 | Osada | |
| 2006/0160419 | A1 * | 7/2006 | Wang | H01R 4/188 439/579 |
| 2006/0252310 | A1 * | 11/2006 | Yamada | H01R 9/0512 439/579 |
| 2009/0029589 | A1 | 1/2009 | Conner et al. | |

FOREIGN PATENT DOCUMENTS

| | | | |
|---|---|---|---|
| JP | 2002-170637 | A | 6/2002 |
| JP | 2006-221863 | A | 8/2006 |
| JP | 2009-140684 | A | 6/2009 |
| JP | 2010-092811 | A | 4/2010 |
| JP | 2012-507824 | A | 3/2012 |

* cited by examiner

CONNECTOR

INCORPORATION BY REFERENCE

This application claims the benefit of Japanese Patent Application No. 2014-036778, filed on Feb. 27, 2014, which is incorporated herein by reference in its entirety.

BACKGROUND

The present invention relates to a connector for use in wiring an electric device and the like.

In general, a connector is used to electrically connect or disconnect an electrical component, an electric device and the like. For instance, Japanese Patent Application Laid-open No. 2010-092811 discloses a multiple electrical connector holding four plug modules which are arrayed side by side and each of which is connected to an end part of a coaxial cable. The plug modules are held in an insulated housing. The insulated housing is provided with a conductive shell attached to an outside thereof to cut off external noises and the like. Each plug module includes a conductive contact provided in a module housing and connected to a center conductor of the coaxial cable and an inner conductive shell provided so as to cover the module housing in which the conductive contact is provided. Because the inner conductive shell is formed by folding a thin plate-like metallic material, a seam is formed structurally.

In transmitting high frequency signals by using a coaxial cable, electromagnetic waves are generated from a conductive contact connected to a center conductor of the coaxial cable in general. Due to that, in the case where multiple conductive contacts are arrayed side by side, electromagnetic waves generated from the respective conductive contacts interfere with each other, generating an electromagnetic field coupling. If the electromagnetic field coupling is generated, an insertion loss increases and an inputted signal (high frequency component in particular) is lost.

Although the multiple electrical connector described in Japanese Patent Application Laid-open No. 2010-092811 is configured to be able to cut off external noises by the outer and inner two conductive shells, no consideration is taken to eliminate the interference between electromagnetic waves generated from a certain plug module and electromagnetic waves generated from another plug module in the interior of the multiple electrical connector. Specifically, the higher the frequency of the signals to be transmitted, the more the electromagnetic waves generated from the respective conductive contacts are apt to leak out of the seam of the inner conductive shell and to generate the electromagnetic field coupling. Therefore, the multiple electrical connector described in Japanese Patent Application Laid-open No. 2010-092811 has a problem that the connector generates a large insertion loss in transmitting a high frequency signal of 5.8 GHz or more for example.

Accordingly, an object of the present invention is to provide a connector that reduces or eliminates interferences of electromagnetic waves generated from the coaxial terminals arrayed side by side and decreases insertion loss.

SUMMARY

An aspect of the connector according to the present invention includes: multiple coaxial terminals each of which is formed into a shape of L, and has a connecting part attached to a coaxial cable and a terminal part bent with respect to the connecting part; a housing including a housing body having storage parts storing the coaxial terminals arrayed side by side and a cover closing the respective storage parts of the housing body; and a radio wave absorbing member disposed between the coaxial terminals stored in the respective storage parts and the cover and extending over the coaxial terminals. The radio wave absorbing member is disposed so as to face at least a bent part in which the terminal part is bent with respect to the connecting part of each of the plurality of coaxial terminals, and provided in contact with or in proximity to each of the coaxial terminals.

Because the terminal part is bent with respect to the connecting part and the coaxial terminal is formed in a shape of L, a seam is structurally formed at a combination part in which the connecting part and the terminal part are combined with, interfere with, or face each other. Further, although the coaxial cable is configured to cut off electromagnetic waves by its coaxial structure, electromagnetic waves are emitted from an exposed center conductor on which a terminal treatment is performed or from the coaxial terminal connected to the center conductor. In this aspect of the connector, the radio wave absorbing member is provided over the adjacent coaxial terminals and is disposed so as to face the bent part of the coaxial terminal. In this configuration, the electromagnetic waves generated from the respective coaxial terminals and heading to the adjacent coaxial terminals are cut off (absorbed) by the radio wave absorbing member. Accordingly, because interference of the electromagnetic waves generated from the coaxial terminals is reduced or eliminated, it is possible to prevent an electromagnetic field coupling from being generated. Thus, this configuration makes it possible to effectively suppress an increase of insertion loss and to accurately transmit high frequency signals.

In another aspect of the connector according to the present invention, the radio wave absorbing member includes: a fixing part fixed to an inner surface of the cover; and multiple contact pieces extending from the fixing part so as to come into contact with the coaxial terminals, respectively.

In this aspect of the connector, the coaxial terminals stored in the housing body can be pressed by the contact pieces, respectively. This configuration makes it possible to suppress fluctuations of the insertion loss generated by moves of the coaxial terminals within the housing body.

In still another aspect of the connector according to the present invention, each of the contact pieces is in contact with a part of one of the coaxial terminals facing a center conductor exposed out of the coaxial cable on which a terminal treatment is performed and which is electrically connected to said one of the coaxial terminals.

In this aspect of the connector, each of the contact pieces of the radio wave absorbing member can cut off the electromagnetic waves generated from the center conductor on which a terminal treatment is performed and heading toward the adjacent coaxial terminals and the center conductors. This configuration makes it possible to prevent the electromagnetic field coupling from being generated and to effectively suppress the increase of insertion loss.

In yet another aspect of the connector according to the present invention, the storage parts adjacent to each other are partitioned by an insulating partition wall.

In this aspect of the connector, the adjacent coaxial terminals are partitioned by the partition walls, so that the coaxial terminals can be held in the positions set in an electrically non-contact condition.

Further aspects of the connector according to the present invention will become apparent from the following description of exemplary embodiments.

DETAILED DESCRIPTION

Figure 1:
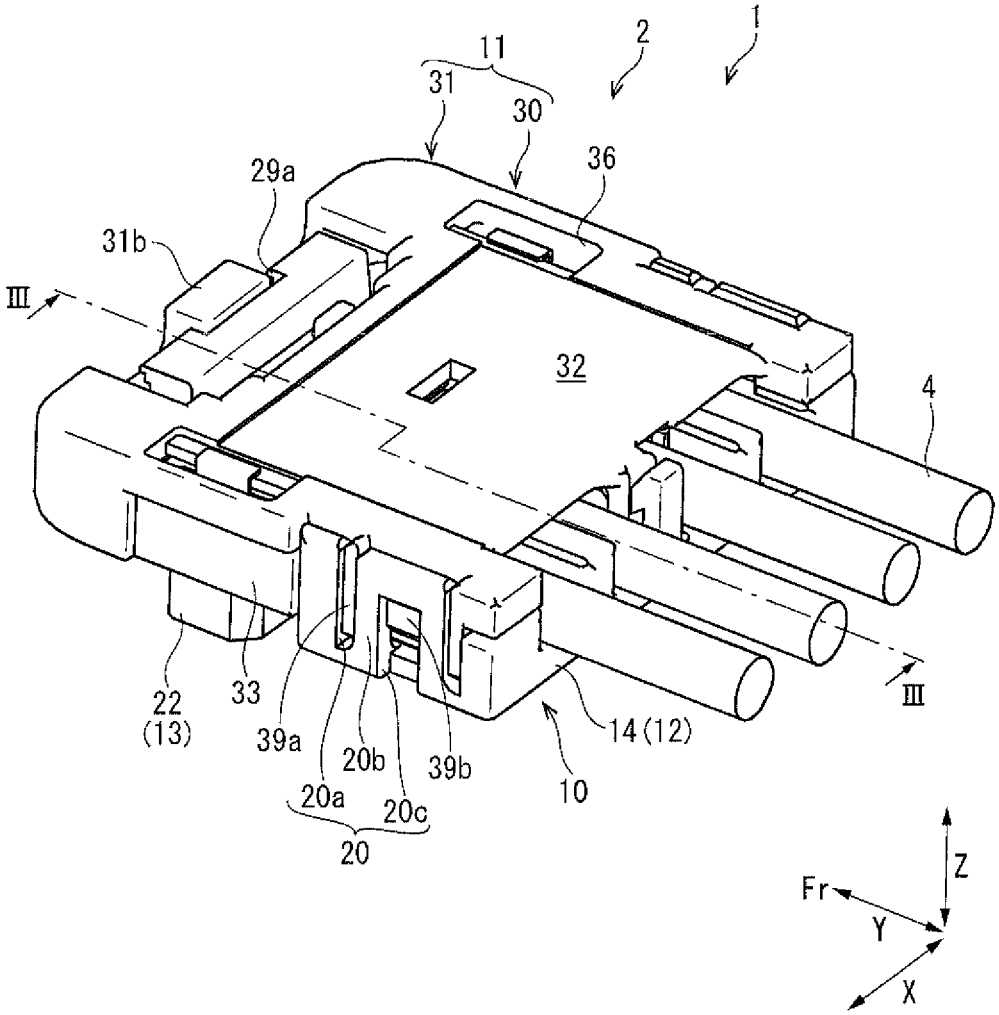
FIG. 1 is a perspective view showing a connector of an embodiment of the present invention viewed from above thereof.

An embodiment of a connector according to the present invention is described herein and in the drawings. For ease of explanation, as shown in the drawings, a front direction is denoted by 'Fr', a right-and-left direction is denoted by X, a front-and-rear direction by Y, and a up-and-down direction by Z.

Figure 2:
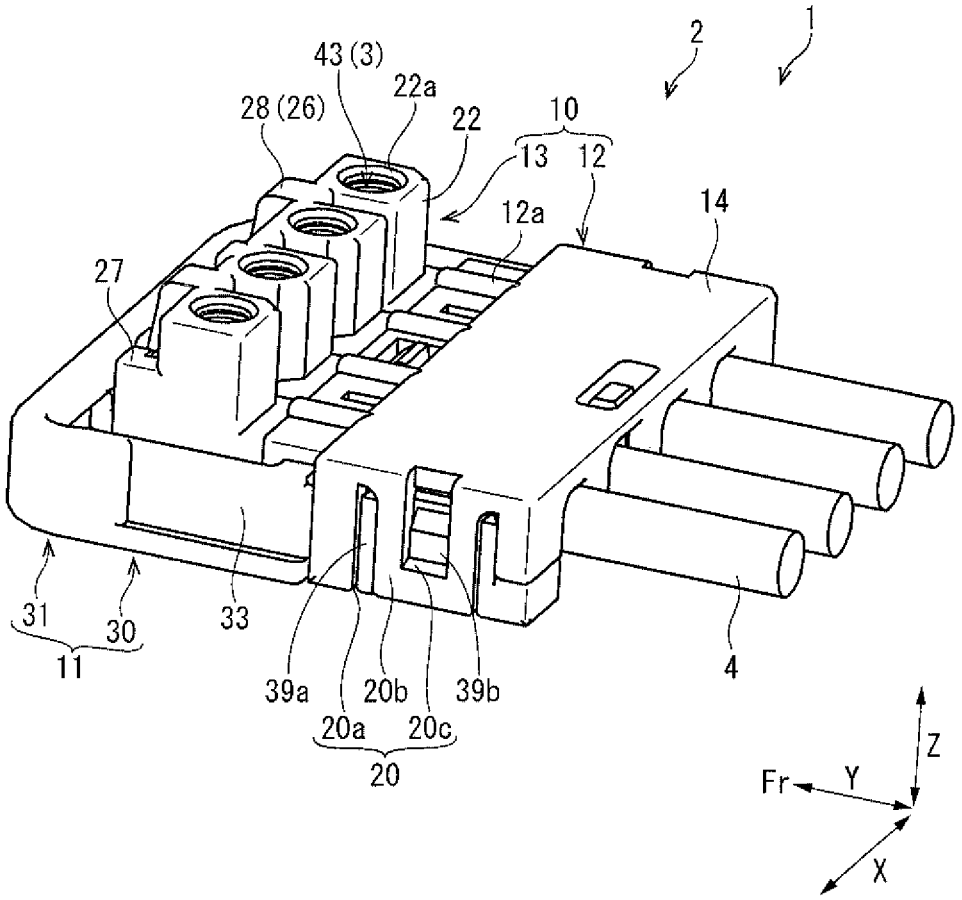
FIG. 2 is a perspective view showing the connector of the embodiment of the present invention viewed from below thereof.
Figure 3:
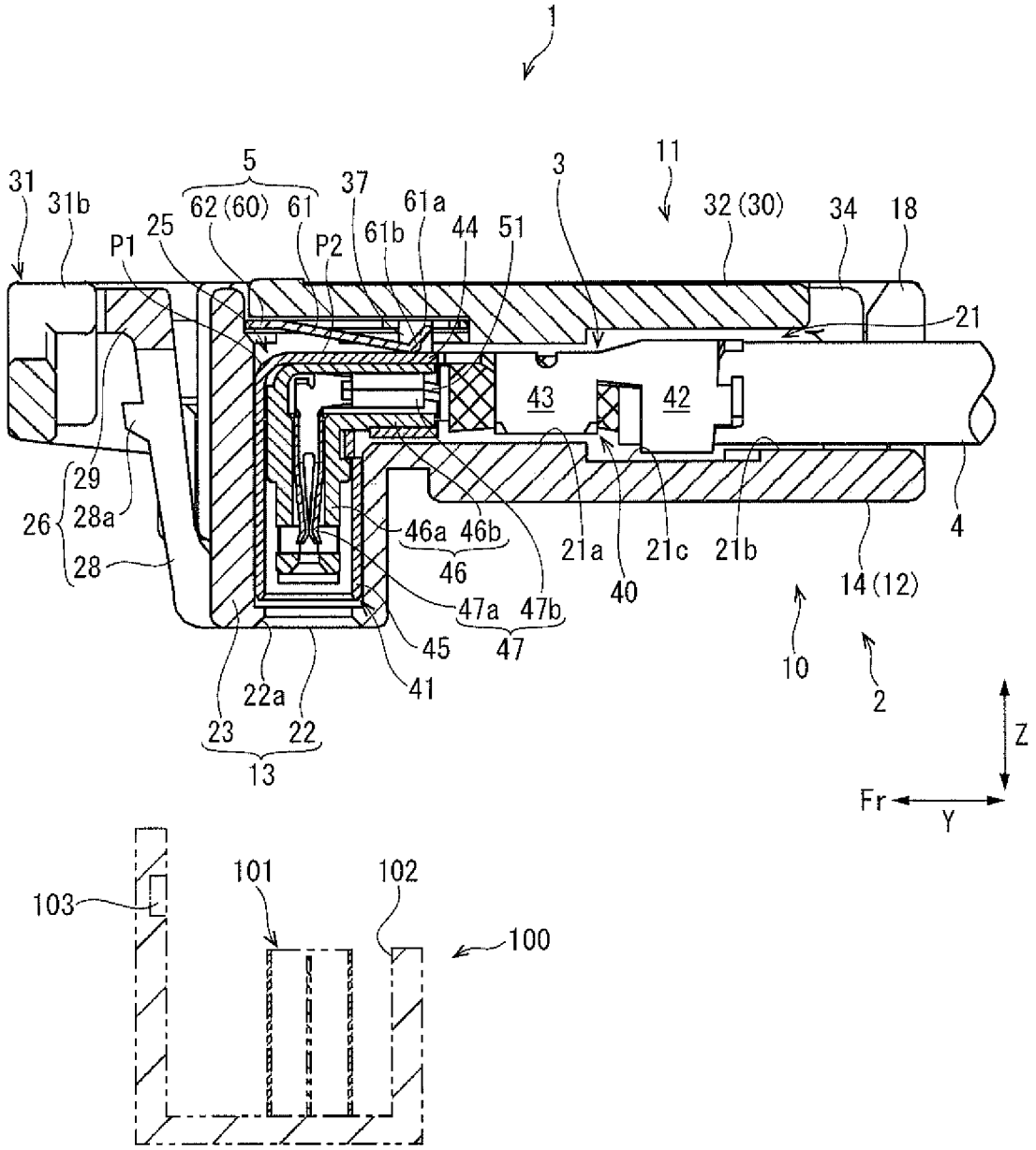
FIG. 3 is a section view showing the connector taken along a line in FIG. 1.
Figure 4:
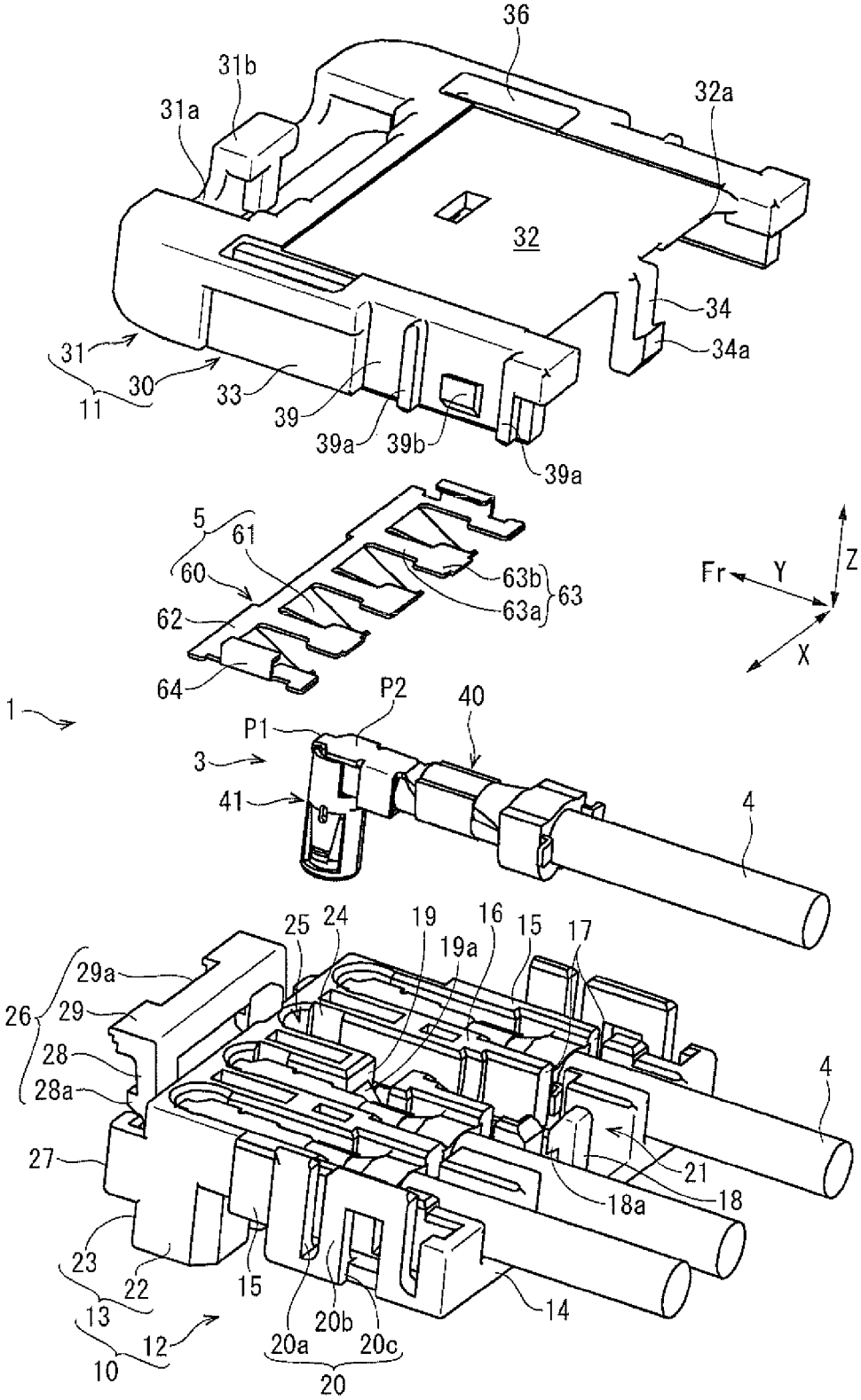
FIG. 4 is an exploded perspective view showing the connector of the embodiment of the present invention.
Figure 5:
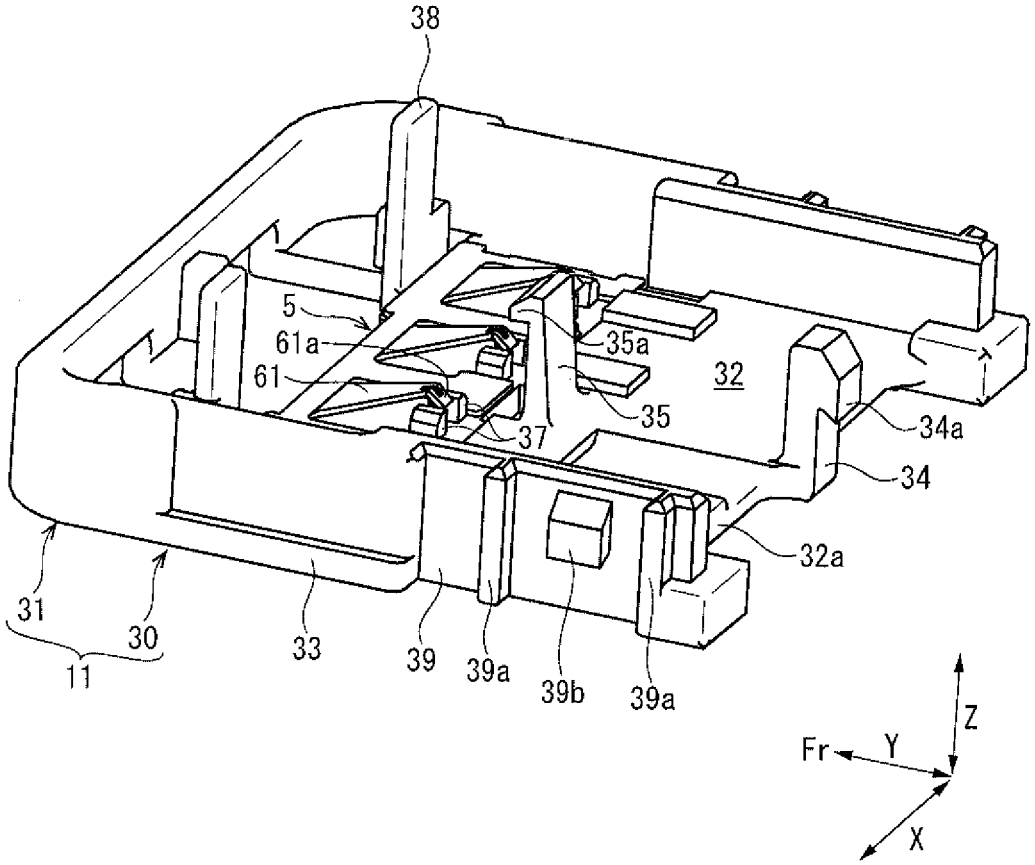
FIG. 5 is a perspective view showing a cover and a radio wave absorbing member of the connector of the embodiment of the present invention viewed from below thereof.
Figure 6:
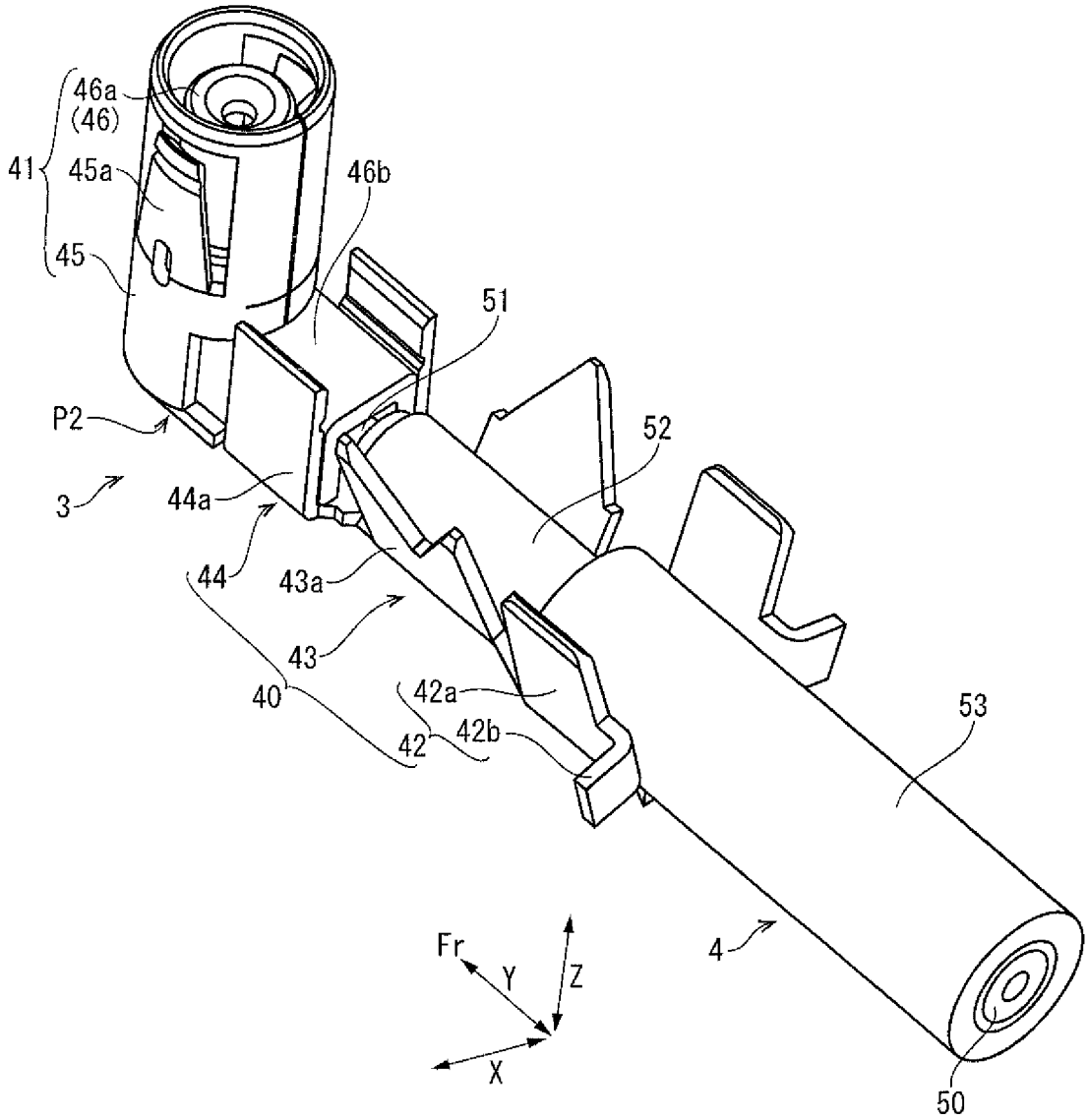
FIG. 6 is a perspective view showing a coaxial terminal of the connector of the embodiment of the present invention in the state before the coaxial terminal is caulked to a coaxial cable.

A configuration of the connector 1 shown in FIGS. 1 to 6, which is an embodiment of a connector according to the present invention, will be explained. FIGS. 1 and 2 are perspective views showing the connector 1. FIG. 3 is a section view of the connector 1 taken along a line in FIG. 1. FIG. 4 is an exploded perspective view showing the connector 1. FIG. 5 is a perspective view showing a cover 11 and others viewed from below thereof. FIG. 6 is a perspective view showing a coaxial terminal 3 in the state before a coaxial terminal 3 is caulked to a coaxial cable 4.

As shown in FIGS. 1 to 3, the connector 1 includes a housing 2 formed substantially into a parallelepiped shape, four coaxial terminals 3 connected respectively to coaxial cables 4 and stored in the housing 2, and a radio wave absorbing member 5 disposed between the housing 2 and the respective coaxial terminals 3. This connector 1 is configured to fit with a mating connector 100 such that the four coaxial terminals 3 are electrically connected to four mating terminals 101 held in the mating connector 100 (see FIG. 3).

The housing 2 is formed of an insulating material such as synthetic resin. The housing 2 has a so-called two piece structure which can be divided into two pieces and includes a housing body 10 storing the coaxial terminals 3 arrayed side by side and the cover 11 closing the housing body 10.

As shown in FIGS. 1 to 4, the housing body 10 includes a body part 12 formed substantially into a rectangular box-like shape which is long in the right-and-left direction and a projecting part 13 formed integrally with the body part 12 so as to project downward from a front end part (tip part) of the body part 12. It is noted that in the explanation of the connector 1 of the present embodiment, a downward direction in FIG. 3 for example is a direction in which the connector 1 is fitted with the mating connector 100 and an upward direction is an anti-fitting direction.

As shown in FIG. 4, the body part 12 includes a base part 14, a pair of outer walls 15 erecting at both end parts in the right-and-left direction of the base part 14, and three base end side partition walls 16 erecting from the base part 14 at equal intervals between the side walls 15.

The outer walls 15 and the base end side partition walls 16 are formed such that their heights are equal. Each of the outer walls 15 is formed to have a step substantially at the center thereof in the front-and-rear direction and such that a front side thereof projects toward inside. Each of the base end side partition walls 16 is formed to have a step substantially at the center thereof in the front-and-rear direction and such that a front side thereof is wide in the right-and-left direction as shown in FIG. 4.

The outer walls 15 and the base end side partition walls 16 are provided with inner locking concave parts 17 formed on the rear side of the walls by cutting downward from an upper end of the walls. Front end surfaces of the five inner locking concave parts 17 are formed at an identical position in the front-and-rear direction. Incidentally, the two inner locking concave parts 17 formed on the right (rear side in FIG. 4) and center base end side partition walls 16 are formed respectively substantially into a shape of L which are symmetrical in a plan view. Specifically, the two inner locking concave parts 17 are formed such that sides thereof facing to each other are widened rearward.

A body side rear end piece 18, which is bendable in the front-and-rear direction, is formed at a rear end part of the base end side partition wall 16 located at the center in the right-and-left direction. The body side rear end piece 18 is formed to be higher (to be long upward) than the respective outer walls 15 and the base end side partition walls 16. The body side rear end piece 18 is provided with a first body side hook **18*a*** formed at a front surface of an upper end part thereof so as to project forward.

The base end side partition wall 16 located at the center in the right-and-left direction is provided with a locking hole 19 penetrating in the up-and-down direction on the front side thereof. The locking hole 19 is provided with a second body side hook **19*a*** projecting rearward on a front inner circumferential surface thereof.

A pair of lock parts 20 is formed integrally with the body part 12 on the rear side of the body part 12 and on outsides of the outer walls 15 located on the right side and the left side, respectively. Each of the lock parts 20 is connected to a lower end part of the outer wall 15 and is formed substantially into a shape of L in front view. Incidentally, outer walls of the lock parts 20 are formed such that their heights equal with the height of the body side rear end piece 18.

An outer piece **20*b* is formed in the outer wall of each locking part 20 between a pair of slits 20*a* arranged in the front-and-rear direction and cut downward from an upper end of the wall. Each outer piece 20*b* is provided with a rectangular locking opening 20*c* cut away upward from a lower end of the wall. Each outer piece 20*b* is formed to be bendable in the right-and-left direction. Incidentally, each lock part 20 is formed such that a rear end part of the outer wall thereof is flush with a rear end surface of the base part 14 and the outer wall 15 and is slightly lower than the base end side partition wall 16**.

The body part 12 includes four storage concave parts 21 each of which is configured by being surrounded by the base part 14, the outer wall 15, and the base end side partition wall 16. The storage concave part 21 is formed as a space whose rear and upper parts are opened to store the coaxial cable 4 and a base end part of the coaxial terminal 3 connected to an end part of the coaxial cable 4. The four storage concave parts 21 adjacent to each other are partitioned by the base end side partition wall 16, and are arrayed side by side substantially at equal intervals in the right-and-left direction.

As shown in FIG. 3, each storage concave part 21 has a reference floor surface 21*a* located on the front side, a convex floor surface 21*b* located on the rear side and formed to be lower than the reference floor surface 21*a* by one step, and a concave floor surface 21*c* located substantially at a center part in the front-and-rear direction and formed to be lower than the convex floor surface 21*b* by one step. Further, as described above, the front side of each outer wall 15 and the front side of each base end side partition wall 16 are formed respectively such that the width in the right-and-left direction of the storage concave part 21 is narrowed. Accordingly, each storage concave part 21 is formed such that the front side thereof is narrower than the rear side thereof in the up-and-down direction and the right-and-left direction (such that a diameter thereof is small). Incidentally, although not clear in FIG. 4, the rear side of the third storage concave part 21 from a front side of FIG. 4 is slightly larger than the other storage concave parts 21 (such that a diameter thereof is large).

Furthermore, four reinforcing ribs 12*a* are formed on the side of the projecting part 13 in an under surface of the body part 12 so as to extend in the front-and-rear direction corresponding to the storage concave parts 21 and project downward (see FIG. 2).

As shown in FIGS. 2 to 4, the projecting part 13 includes the four split projecting parts 22 arrayed side by side at equal intervals in the right-and-left direction and a front end wall 23 formed integrally with the four split projecting parts 22 so as to link surfaces of the four split projecting parts 22. An upper end surface of the projecting part 13 is flush with an upper end surface of the body part 12.

Each of the four split projecting parts 22 is formed substantially into a rectangular box-like shape which is long in the up-and-down direction. An upper end surface of each split projecting part 22 is opened (see FIG. 4). A circular terminal opening 22*a* is opened at a lower end surface of each split projecting part 22 (see FIG. 2).

As shown in FIG. 4, a tip side partition wall 24 extending from the front end part of each base end side partition wall 16 is formed integrally with the base end side partition wall 16 between the adjacent split projecting parts 22 within an upper part of the projecting part 13.

A storage hole part 25 communicating a terminal opening part 22*a* with the storage concave part 21 is formed in the up-and-down direction within each of the four split projecting parts 22. Each storage hole part 25 is formed in communication with the storage concave part 21 to store the tip part of the coaxial terminal 3. The four adjacent storage hole parts 25 are arrayed side by side in the right-and-left direction while being parted by the tip side partition walls 24. Further, each storage hole part 25 is formed to be slightly larger than the terminal opening part 22*a*. Incidentally, the storage concave part 21 and the storage hole part 25 are examples of a 'storage part' and the base end side partition wall 16 and the front tip side partition wall 24 are examples of a 'partition wall'.

As shown in FIGS. 3 and 4, the front end wall 23 is provided with a lock arm 26 and a pair of right and left guide hooks 27.

The lock arm 26 includes a pair of right and left arm bodies 28 extending upward while slightly inclining forward from a lower end part of the front end wall 23 and a lock control part 29 linking upper end parts of the arm bodies 28.

Each arm body 28 is formed to be bendable in the front-and-rear direction. Each arm body 28 is formed to have the equal height with each outer piece 20*b* and the body side rear end piece 18 described above. Each arm body 28 is provided with a lock projection 28*a* projecting at an upper part of a front surface thereof. The lock control part 29 is formed to project slightly forward of the arm bodies 28. The lock control part 29 is provided with a rectangular lock concave part 29*a* cut rearward from a front end at a center part thereof in the right-and-left direction (see FIG. 4).

As shown in FIG. 4, a pair of guide hooks 27, which is located on the right and left sides, is formed symmetrically with each other and is flush with an outside surface of the split projecting parts 22 located at both right and left ends. Each of the guide hooks 27 is formed substantially into a shape of L in plan view such that a tip part extending forward is bent inside.

Next, the cover 11 shown in FIGS. 1, 4 and 5 will be explained. The cover 11 covers each of the storage concave parts 21 and the storage hole parts 25 of the housing body 10 from above them. The cover 11 includes a cover body 30 formed so as to cover the housing body 10 and a handle 31 formed integrally with the cover body 30 so as to extend forward from a front end part of the cover body 30.

The cover body 30 includes a plate part 32 formed substantially into a rectangular plate substantially covering the housing body 10 and a pair of vertical walls 33 provided vertically (so as to extend in the up-and-down direction) at both right and left end parts of the plate part 32.

The plate part 32 is provided with a rectangular plate concave part 32*a* cut forward from a rear end thereof. The plate concave part 32*a* is provided with a cover side rear end piece 34 extending in the up-and-down direction and bendable in the front-and-rear direction at a center part thereof in the right-and-left direction. The cover side rear end piece 34 is formed to be slightly longer downward than the vertical walls 33. The cover side rear end piece 34 is provided with a first cover side hook 34*a* projecting rearward on a rear surface of a lower end part thereof.

As shown in FIG. 5, the plate part 32 is provided with a cover side intermediate hook 35 extending in the up-and-down direction and bendable in the front-and-rear direction substantially at a center part of an under surface thereof. The cover side intermediate hook 35 is formed to have substantially an equal length with the cover side rear end piece 34. The cover side intermediate hook 35 is provided with a second cover side hook 35*a* formed to project forward on a front surface of a lower end part thereof.

As shown in FIGS. 1 and 4, the plate part 32 is provided with fixing openings 36 extending in the front-and-rear direction and having a long and narrow rectangular shape, and the fixing openings 36 are formed in right and left parts on the front side of the plate part 32 so as to penetrate through the parts, respectively. Further, as shown in FIG. 5, the plate part 32 is provided with four sets of pressing projection pair 37 at positions corresponding to the respective storage concave parts 21 at a front under surface thereof. The plate part 32 is provided also with a pair of right and left guide pieces 38 at positions corresponding to the respective guide hooks 27.

As shown in FIGS. 4 and 5, each of the vertical walls 33 is provided with a concave wall part 39 formed so as to dent inside substantially at a rear half thereof. The concave wall part 39 is provided with a pair of convex stripe parts 39*a* arranged in the front-and-rear direction and projecting from an upper end to a lower end of the wall. The concave wall part 39 is provided also with a locking projection 39*b* between the convex stripe parts 39*a*. Incidentally, an upper part of the rear convex stripe part 39*a* is formed into a shape of a block.

The handle 31 is formed substantially into a shape of a rectangular arch to connect both right and left ends of the plate part 32. The handle 31 is provided with a substantially rectangular handle concave part 31*a* cut down from an upper end of the handle 31 in front view (see FIG. 4). A handle convex part 31*b* extending upward is formed at a center part of the handle concave part 31*a* in the right-and-left direction. The handle convex part 31*b* is formed such that a front end thereof is bent rearward, i.e., substantially into a shape of L in side view. Incidentally, an upper surface of the cover body 30 is flush with an upper surface of the handle 31 including that of the handle convex part 31*b*.

Next, each of the coaxial terminals 3 shown in FIGS. 3 and 6 will be explained. It is noted that because the four coaxial terminals 3 have an identical structure, respectively, the following explanation will be made by noticing on one coaxial terminal 3.

As shown in FIG. 6, the coaxial terminal 3 is formed into a shape of L by having a connecting part 40 axially (in the front-and-rear direction) attached to the end part of the coaxial cable 4 and a terminal part 41 bent with respect to the connecting part 40.

The coaxial cable 4 connected to the coaxial terminal 3 is composed of a center conductor 51, an outer conductor 52 provided around the center conductor 51, an insulator 50 provided between the center conductor 51 and the outer conductor 52, and an outer cover 53 covering the external conductor 52.

The connecting part 40 is composed of a conductive material such as metal. The connecting part 40 includes, in order from the rear side, a cover crimping barrel part 42, an external conductor crimping barrel part 43 and an insulator surrounding part 44.

The cover crimping barrel part 42, before its caulking, has a pair of right and left cover crimping pieces 42*a* which is formed substantially into a shape of U in rear view. In the same manner, the external conductor crimping barrel part 43 has a pair of right and left conductor crimping pieces 43*a*, and the insulator surrounding part 44 has a pair of right and left surrounding pieces 44*a*. The cover crimping piece 42*a* and the surrounding piece 44*a* are formed so as to be in the shape of a long and narrow rectangle in side view and extend in the up-and-down direction, respectively. One of the conductor crimping pieces 43*a* is formed such that its edge is formed into a triangular shape and another one of the conductor crimping pieces 43*a* is formed such that its edge is formed into a shape of V.

The cover crimping barrel part 42 is provided with a pair of right and left locking convex pieces 42*b* at a rear end thereof. Each locking convex piece 42 extends out in the right-and-left direction substantially at a center of the cover crimping piece 42*a* in the up-and-down direction.

The terminal part 41 includes, in order from outside thereof, a terminal external conductor 45, a terminal insulator 46, and a terminal inner conductor 47 (see FIG. 3).

The terminal external conductor 45 is formed into a cylindrical shape through bending works performed on one sheet metal (conductive material) integrated with the connecting part 40. The terminal external conductor 45 is provided with a pair of right and left fitting piece parts 45*a* formed and cut substantially into a trapezoidal shape at a tip part thereof.

The terminal insulator 46 is composed of an insulating material. The terminal insulator 46 includes an insulated body part 46*a* formed into a cylindrical shape and an insulated projecting part 46*b* formed into a rectangular cylindrical shape. The insulated body part 46*a* is provided within the terminal external conductor 45. The insulated projecting part 46*b* is bent into a shape of L from a base end part of the insulated body part 46*a* to the insulator surrounding part 44 side and is disposed between the pair of surrounding pieces 44*a*.

As shown in FIG. 3, the terminal inner conductor 47 includes an inner conductor body part 47*a* and an inner conductor crimping barrel part 47*b* each of which is composed of a conductive material. The inner conductor body part 47*a* is provided within the insulated body part 46*a* and a tip part thereof is forked into two parts. The inner conductor crimping barrel part 47*b* is bent into a shape of L from the base end part of the inner conductor body part 47*a* to the insulator surrounding part 44 side and is provided within the insulated projecting part 46*b*.

Next, steps for connecting the coaxial terminal 3 to the coaxial cable 4 will be explained. The connecting part 40 and the terminal part 41 are formed straightly before the coaxial terminal 3 is attached to the coaxial cable 4.

Firstly, an operator performs a terminal treatment on each coaxial terminal 4 to expose center conductor 51, and caulks the inner conductor crimping barrel part 47*b* of the terminal inner conductor 47 to the exposed center conductor 51. After that, the operator bents the terminal part 41 into the shape of L with respect to the connecting part 40. Next, the operator caulks the cover crimping barrel part 42 to the external cover 53 of the coaxial cable 4 and caulks the external conductor crimping barrel part 43 to the external conductor 52. The operator bents each surrounding piece 44*a* of the insulator surrounding part 44 so as to wrap the insulated projecting part 46*b*.

Thereby, the coaxial terminal 3 attached with the coaxial cables 4 is constructed (see FIG. 4). It is noted that the connecting part 40 and the terminal part 41 (or more accurately, the terminal external conductor 45) are composed of one sheet metal. Due to that, when the sheet metal is bent into the shape of L, a bent part P1 is formed between the connecting part 40 and the terminal part 41 (see FIGS. 3 and 4). Behind the bent part P1, a combination part P2 where the connecting part 40 and the terminal part 41 are combined with, interfere with, or face each other is formed (see FIGS. 3 and 4). A seam is formed structurally at this combination part P2.

Figure 7:
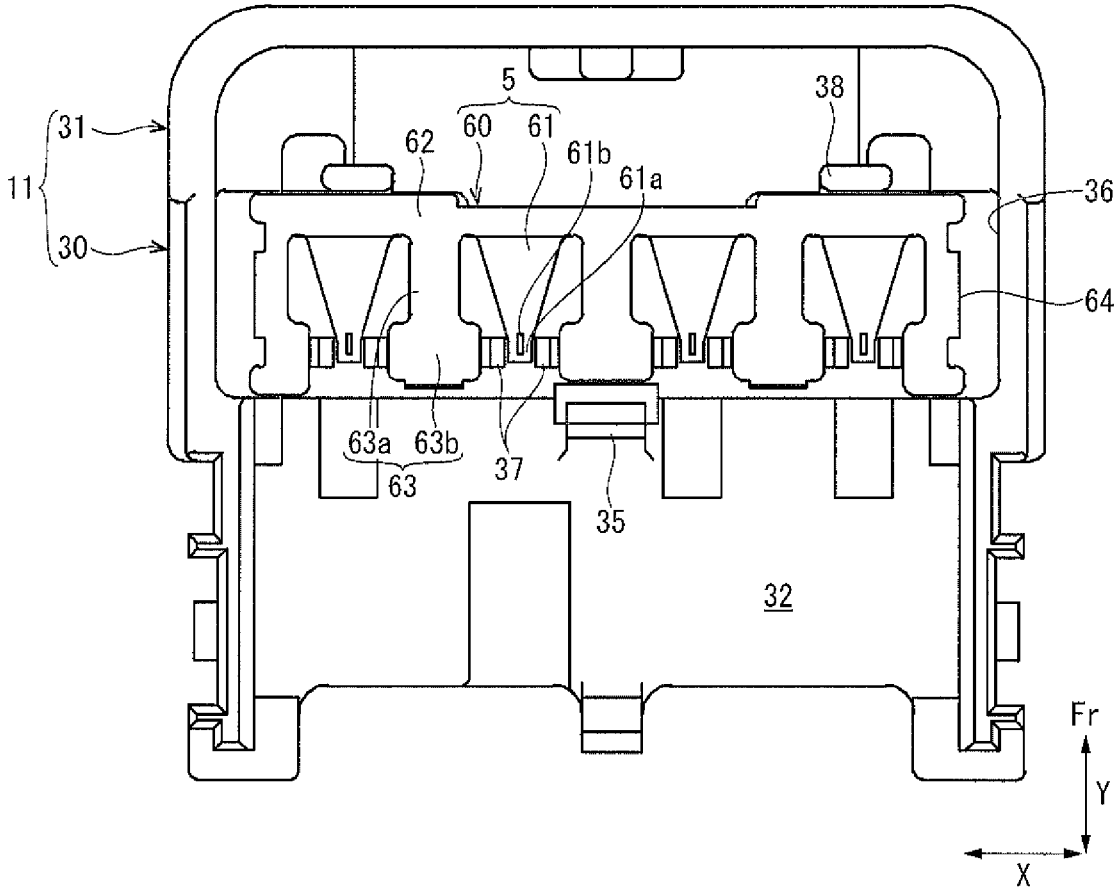
FIG. 7 a bottom view showing the cover and the radio wave absorbing member of the connector of the embodiment of the present invention.
Figure 8:
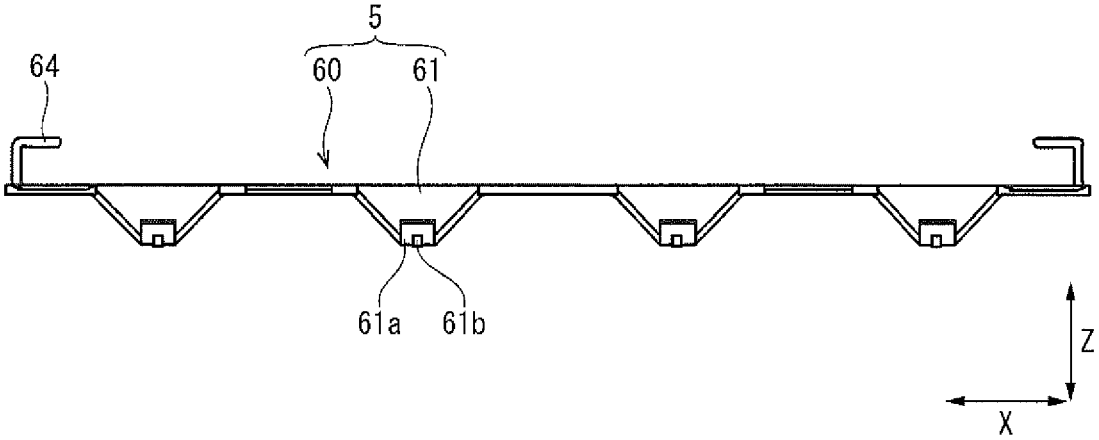
FIG. 8 is a rear view showing the radio wave absorbing member of the connector of the embodiment of the present invention.
Figure 9:
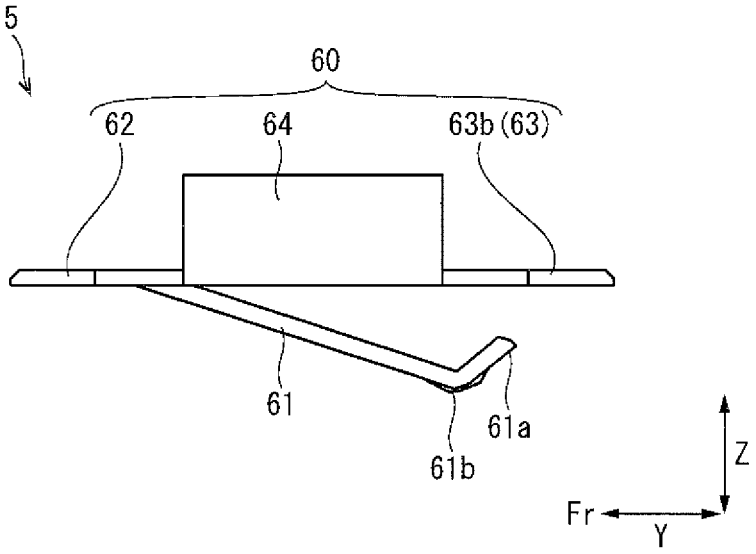
FIG. 9 is a side view showing the radio wave absorbing member of the connector of the embodiment of the present invention.

Next, the radio wave absorbing member 5 shown in FIGS. 4, 5, 7 to 9 will be explained. FIG. 7 is a bottom view showing the cover 11 and the radio wave absorbing member 5. FIGS. 8 and 9 are back and side views showing the radio wave absorbing member 5.

The radio wave absorbing member 5 absorbs and/or reflects electromagnetic waves (radio waves). For instance, the radio wave absorbing member 5 is composed of a conductive radio absorbing material and transforms an electric current generated by the electromagnetic waves into heat by electrical resistance within the material. The radio wave absorbing member 5 is integrally formed of one thin stainless steel plate, e.g., around 0.1 mm or more and 0.5 mm or less of thickness, by performing press working or the like on the plate.

As shown in FIG. 4, the radio wave absorbing member 5 is disposed between the coaxial terminal 3 stored in each storage concave part 21 and each storage hole part 25 and the cover 11 and extends over the four coaxial terminals 3 arranged adjacent to each other. The radio wave absorbing member 5 has a fixing part 60 fixed to an inner surface of the cover 11 and four contact pieces 61 extending from the fixing part 60 so as to come into contact with the coaxial terminals 3, respectively.

As shown in FIGS. 4 and 7 to 9, the fixing part 60 includes a belt-like fixing part body 62 extending over the four coaxial terminals 3 in the right-and-left direction, five restricting parts 63 extending rearward from the fixing part body 62, and a pair of engage parts 64 bending upward from the restricting parts 63 of both right and left sides.

The five restricting parts 63 are arrayed side by side substantially at equal intervals in the right-and-left direction. Each restricting part 63 includes a belt-like restricting extension part 63*a* connected with a rear side edge of the fixing part body 62 and extending rearward and a restricting fitting part 63*b* connected to the rear end of the restricting extension part 63*a*. Incidentally, the restricting parts 63 (the restricting fitting part 63*b* and the restricting extension part 63*a*) at the both right and left sides are formed such that the restricting part 63 is divided substantially into right and left parts.

Each restricting extension part 63*a* is cantilevered with respect to the fixing part body 62. Each restricting fitting part 63*b* is formed substantially into a rectangular shape whose width in the right-and-left direction is wider than the width of the restricting extension part 63*a*.

The right and left engage parts 64 are symmetrical from each other, and each engage part 64 is formed substantially into a shape of L in front view such that a tip part thereof extending upward is bent inside (see FIG. 8).

As shown in FIGS. 4, 7 and 8, the four contact pieces 61 are disposed between the adjacent pairs of restricting parts 63, respectively. Each contact piece 61 is formed substantially into a rectangular shape such that it is narrow on the rear side in bottom view (See FIG. 7). Each contact piece 61 is formed so as to extend rearward from the rear edge of the fixing part body 62 and to incline downward (see FIG. 9). Each contact piece 61 is formed to be bendable or displaceable in the up-and-down direction with elasticity with respect to the part connected with the fixing part body 62.

As shown in FIGS. 8 and 9, each contact piece 61 is provided with a bent piece 61*a* bent obliquely upward at a rear end part thereof. Each contact piece 61 is also provided with a contact projection 61*b* projecting slightly downward at the part where the bent piece 61*a* of the contact piece 61 is bent.

As shown in FIGS. 5 and 7, the radio wave absorbing member 5 is fixed to the inner surface (under surface) of the cover 11 facing to the respective storage concave parts 21 and the respective storage hole parts 25. Specifically, the operator places the radio wave absorbing member 5 between the cover side intermediate hook 35 and the respective guide pieces 38 on the backside of the cover 11. Then, the operator inserts the pair of right and left engage parts 64 of the radio wave absorbing member 5 through the pair of right and left fixing openings 36 opened through the plate parts 32 of the cover 11. Because the radio wave absorbing member 5 is integrally formed of the thin stainless steel plate, each of the engage parts 64 elastically deforms outside in the right-and-left direction, passes through the fixing opening 36, and deforms inside in the right-and-left direction by its own resilience after passing through the fixing opening 36. Thereby, the pair of right and left engage parts 64 is caught by edge parts of the fixing openings 36 and the radio wave absorbing member 5 is fixed such that the radio wave absorbing member 5 holds the plate part 32 (see FIG. 1).

In this state, each restricting fitting part 63*b* fits between a pair of pressing projections 37 so that its position is restricted in the right-and-left direction. Further, the bent piece 61*a* of each contact piece 61 is disposed between the pair of pressing projections 37 so that its position is restricted in the right-and-left direction.

Next, steps for assembling the connector 1 of the present embodiment will be explained.

As shown in FIG. 4, the operator removes the cover 11 to expose the storage concave parts 21 and the storage hole parts 25 of the housing 2. Then, the operator inserts the terminal part 41 of the coaxial terminal 3 (including a part of the coaxial cable 4) into the storage hole part 25 and inserts the connecting part 40 of the coaxial terminal 3 into the storage concave part 21. At this time, the operator inserts the pair of right and left locking convex pieces 42*b* formed in the connecting part 40 into the inner locking concave parts 17 cut in the outer wall 15 and the base end side partition wall 16. This arrangement makes it possible to restrict the coaxial terminal 3 from being pulled out even if the coaxial cable 4 is pulled rearward.

The operator inserts the other coaxial terminals 3 with the same procedure. Thereby, the connecting parts 40 are stored in the four storage concave parts 21 formed in the body part 12 and the terminal parts 41 are stored in the four storage hole parts 25 formed in the projecting part 13, respectively. That is, the four coaxial terminals 3 are stored in the housing 2 side by side in the right-and-left direction. In this state, in the storage concave part 21, the coaxial cable 4 is disposed on the convex floor surface 21*b*, the cover crimping barrel part 42 is disposed on the concave floor surface 21*c*, and the external conductor crimping barrel part 43 and the insulator surrounding part 44 are disposed on the reference floor surface 21*a* (see FIG. 3).

It is noted that the coaxial terminal 3, whose locking convex part 42*b* is provided at the position moved rearward more than normal one, is stored in the third storage concave part 21 from the front side in FIG. 4. This coaxial terminal 3 is used for transmission of high frequency signals or the like for example. The two base end side partition walls 16 forming the third storage concave part 21 are provided with the inner locking concave parts 17 formed widely toward the rear side as described above. Therefore, the coaxial terminal 3 in which the position of the locking convex part 42*b* is changed cannot be stored in the other storage concave parts and can be stored only in the third storage concave part 21 in FIG. 4. This arrangement makes it possible to clearly identify the storage position of the coaxial terminal 3 used for a special purpose and to prevent it from being stored in an erroneous position.

Next, the operator attaches the cover 11 over the housing 2. The operator inserts the tip part of each guide piece 38 of the cover 11 to each guide hook 27 of the housing 2 and presses the cover 11 down. In response to the advance of pressing, each vertical wall 33 of the cover 11 advances between each outer wall 15 and each locking part 20 of the housing 2, and a pair of front and rear convex stripe parts 39*a* formed on each vertical wall 33 enters a pair of front and rear slits 20*a* formed on each of the locking parts 20. In succession, the locking projection 39*b* formed on each vertical wall 33 comes into contact with the upper end part of the outer piece 20*b* formed on each locking part 20. Then, along with the advance of pressing of the cover 11, each outer piece 20*b* is pressed and widened to outside in the right-and-left direction. In response to the further advance of pressing, each locking projection 39*b* of the cover 11 engages with each locking opening 20*c* of the housing 2 by the resilience of each outer piece 20*b*.

Further, in response to the advance of pressing of the cover 11, the lower end part of the cover side rear end piece 34 of the cover 11 comes into contact with the upper end part of the body side rear end piece 18 of the housing 2. Along with the advance of pressing of the cover 11, the cover side rear end piece 34 bends forward and the body side rear end piece 18 bends rearward. In response to the further advance of pressing, the first cover side hook 34*a* of the cover side rear end piece 34 engages with the first body side hook 18*a* of the body side rear end piece 18 by the resilience of the respective pieces 18 and 34.

Furthermore, along with the advance of pressing of the cover 11, the lower end part of the cover side intermediate hook 35 of the cover 11 (see FIG. 5) enters the locking hole 19 of the housing 2 and comes into contact with the upper end part of the second body side hook 19*a*. Along with the advance of pressing of the cover 11, the cover side intermediate hook 35 bends rearward. Along further with the advance of pressing of the cover 11, the second cover side hook 35*a* of the cover side intermediate hook 35 engages with the second body side hook 19*a* by the resilience of the cover side intermediate hook 35.

Thereby, the cover 11 is finished to be pressed down and is fixed to the housing 2 while closing the storage concave parts 21 and the storage hole parts 25, respectively (see FIGS. 1 and 2). That is, the connector 1 is completed to be assembled.

In the state in which the connector 1 is assembled, the under surface of the plate part 32 of the cover 11 is in contact with the upper end surface of each outer wall 15 and each base end side partition wall 16. Further, as shown in FIG. 1, the rear end parts of the base end side partition walls 16 located at the both right and left ends are exposed out of the plate concave part 32*a* of the plate part 32. Furthermore, the lock control part 29 of the lock arm 26 is disposed inside of the arch-like handle 31. The handle convex part 31*b* of the handle 31 is disposed in the lock concave part 29*a* so as to restrict the control of the lock control part 29. This arrangement makes it possible to prevent an erroneous control of the lock control part 29.

As shown in FIG. 3, in the state in which the connector 1 is assembled, the four sets of the pair of pressing projections 37 are in contact with the insulator surrounding part 44 formed in the connecting part 40 of each of the stored coaxial terminals 3, respectively. This arrangement makes it possible to fix the position of the coaxial terminal 3 in the up-and-down direction within each storage concave part 21.

As shown in FIG. 3, in the state in which the connector 1 is assembled, the radio wave absorbing member 5 is disposed so as to face (or cover) at least the bent part P1 and the combination part P2 between the connecting part 40 and the terminal part 41 of each coaxial terminal 3 and also face (or cover) the center conductor 51 exposed out of each coaxial cable 4 on which the terminal treatment is performed. More specifically, the fixing part body 62 of the radio wave absorbing member 5 is disposed above the bent part P1 of the coaxial terminal 3 so as to be slightly separate (in proximity) from the bent part P1. Further, each restricting part 63 extending in the axial direction of the connecting part 40 is disposed so as to face the external conductor 52 exposed out of the coaxial cable 4 on which the terminal treatment is performed.

Further, the radio wave absorbing member 5 is provided in contact with each coaxial terminal 3. More specifically, in the assembling process (of pressing down the cover 11), the contact projection 61*b* of each contact piece 61 extending in the axial direction of the connecting part 40 comes into contact with the connecting part 40 (the insulator surrounding part 44) of the coaxial terminal 3 and each contact piece 61 bends slightly upward along with the advance of pressing of the cover 11. Then, when the connector 1 is completely assembled, each contact piece 61 is put into a state in which the contact piece 61 is in pressure contact with the insulator surrounding part 44 with its resilience. That is, each contact piece 61 (the contact projection 61*b*) is in contact with a position facing to the center conductor 51 exposed out of the coaxial cable 4 on which the terminal treatment is performed and electrically connected to the coaxial terminal 3. It is noted that along with the bend of each contact piece 61, each contact projection 61*b* moves slightly rearward while sliding on a surface of the insulator surrounding part 44. At this time, because the bent piece 61*a* is guided by the pair of pressing projections 37, each contact projection 61*b* moves linearly without deviating in the right-and-left direction.

Next, a procedure for connecting (fitting) the connector 1 to the mating connector 100 shown in FIG. 3 will be briefly explained. It is noted that each mating terminal 101 of the mating connector 100 is supposed to be electrically connected to a circuit on a substrate or a cable (both not shown) for example.

The operator inserts the projecting part 13 of the housing 2 to a fitting concave part 102 of the mating connector 100. In response to the advance of pressing of the connector 1, the lock arm 26 of the projecting part 13 (each arm body 28) comes into contact with an upper end part of the mating connector 100 and along with the advance of pressing of the connector 1, each arm body 28 bends rearward at a fulcrum of a part connected with the front end wall 23. In response to the further advance of pressing, the lock projection 28*a* of each arm body 28 engages with a mating locking opening 103 of the mating connector 100 by the resilience of each arm body 28. Each coaxial terminal 3 of the connector 1 is also connected with each mating terminal 101 of the mating connector 100. Thereby, the connection (fitting) of the connector 1 with the mating connector 100 is completed.

On the other hand, the connector 1 may be disconnected from the mating connector 100 as follows. The lock control part 29 of the lock arm 26 is pressed rearward to disengage each lock projection 28*a* from the mating locking opening 103. Then the connector 1 is pulled out upward from the mating connector 100. Thus, the connector 1 can be taken out of the mating connector 100.

As described above, because the coaxial terminal 3 is bent into the shape of L at the connecting part 40 and the terminal part 41, the seam is formed structurally at the combination part P2. Further, although the coaxial cable 4 is configured to cut off electromagnetic waves by providing the external conductor 52, electromagnetic waves are emitted from the center conductor 51 exposed by the terminal treatment and the coaxial terminal 3 connected thereto.

According to the connector 1, the radio wave absorbing member 5 is provided over the four coaxial terminals 3 arranged adjacent to each other and is disposed so as to face the bent part P1 and the combination part P2 of each coaxial terminal 3 and the center conductor 51 on which the terminal treatment is performed. Therefore, the electromagnetic waves generated from each coaxial terminal 3 and each center conductor 51 and heading to the adjacent coaxial terminals 3 and others is cut off (absorbed and/or reflected) by the radio wave absorbing member 5. Accordingly, because the radio wave absorbing member 5 reduces or eliminates an interference of the electromagnetic waves generated from the coaxial terminals 3 and others, it is possible to prevent electromagnetic field couplings from being generated. Thus, this arrangement makes it possible to effectively suppress an increase of an insertion loss and to accurately transmit high frequency signals of 5.8 GHz or more for example.

Further, according to the connector 1, the radio wave absorbing member 5 is fixed to the inner surface (under surface) of the cover 11, so that it is possible to readily assemble the connector 1 capable of preventing the generation of the electromagnetic field couplings by the simple procedure of mounting the cover 11 to the housing body 10 storing the coaxial terminals 3. Furthermore, because the radio wave absorbing member 5 is fixed to the inner surface of the cover 11, it is possible to prevent displacement of the radio wave absorbing member 5 in assembling and using the connector 1.

Furthermore, according to the connector 1, each coaxial terminal 3 stored in the housing body 10 can be pressed by each contact piece 61. This arrangement makes it possible to suppress fluctuations of the insertion loss generated by moves of the coaxial terminals 3 within the housing body 10 (each storage concave part 21).

Furthermore, according to the connector 1, the four coaxial terminals 3 arranged adjacent to each other are isolated respectively by the base end side partition walls 16 and the front tip side partition walls 24, so that each coaxial terminal 3 can be held at a position set in an electrically non-contact state.

By the way, the insulating partition walls 16 and 24 have high dielectric constants as compared to air, so that wavelength of the electromagnetic waves passing through the respective partition walls 16 and 24 is shortened and the electromagnetic waves are liable to leak out of the seam of the combination part P2 of the coaxial terminal 3. Due to that, the electromagnetic field coupling is liable to be generated between the adjacent coaxial terminals 3 and others. However, according to the connector 1, the electromagnetic waves generated from the respective coaxial terminals 3 are cut off by the radio wave absorbing member 5, so that it is possible to prevent the electromagnetic field couplings from being generated. This configuration makes it possible to suppress the increase of the insertion loss accompanying to the electromagnetic field coupling and to accurately transmit high frequency signals.

It is noted that although the four coaxial terminals 3 are provided in the connector 1, the number of coaxial terminals is not limited as long as more than one coaxial terminal is provided. Further, although the multiple coaxial terminals 3 are arrayed side by side substantially at equal intervals in the right-and-left direction, the arrangement of the coaxial terminals 3 is not limited to this. The coaxial terminals may be arrayed at unequal intervals or may be arrayed while being offset in the front-and-rear direction more or less for example.

Further, although the stainless steel radio wave absorbing member 5 is used in the connector 1, the material of the radio wave absorbing member 5 is not limited to this. A conductive radio absorptive material such as copper and aluminum for example may be used as the material of the radio wave absorbing member 5. Furthermore, as the material of the radio wave absorbing member 5, a dielectric radio absorptive material in which a conductive material such as carbon is blended with a dielectric substance such as rubber, urethane and polystyrol may be used, or a magnetic radio absorptive material absorbing radio by a magnetic material such as iron, nickel and ferrite may be also used.

It is noted that although the fixing part body 62 is disposed at the position slightly separated from the bent part P1 of the coaxial terminal 3 in the connector 1, the fixing part body 62 may be brought into contact with the bent part P1 or the combination part P2 of the coaxial terminal 3 for example. Furthermore, while the radio wave absorbing member 5 is in contact with each coaxial terminal through each contact piece 61 in the connector 1, the radio wave absorbing member 5 may be provided in proximity to each of the coaxial terminals 3 (i.e. so as not to be in contact with the coaxial terminals 3). More specifically, in this case, a distance between a closest part of the radio wave absorbing member 5, e.g., each contact piece 61, and each coaxial terminal 3 (at least either one of the connecting part 40 and the terminal part 41) is preferable to be 0.5 mm or less. This distance is more preferable to be 0.1 mm or less. It has been confirmed that it is possible to prevent the electromagnetic field couplings from being generated and to effectively suppress the increase of the insertion loss even when the radio wave absorbing member 5 is disposed in proximity to each of the coaxial terminals 3 as described above.

It is noted that while the radio wave absorbing member 5 is fixed to the cover 11 through the engage parts 64 in the connector 1. The way of attaching the radio wave absorbing member 5 is not limited to this. For instance, a radio wave absorbing member from which each engage part 64 is omitted or a radio wave absorbing member simply formed into a thin plate may be provided so as to be sandwiched between each of the coaxial terminals 3 and the cover 11. The radio wave absorbing member may be pasted to each of the coaxial terminals 3 or to (the inner surface of) the cover 11. The radio wave absorbing member may be also insert-molded to the cover 11 for example.

Further, a radio wave absorbing member that covers the whole housing body 10 may be provided in order to cover the bent part P1 of each of the coaxial terminals 3. The shape of the radio wave absorbing member 5 is arbitrary and may be formed into a rectangular or circular plate (oval plate) for example. The radio wave absorbing member 5 may be also provided so as to cover not all of the coaxial terminals 3 arrayed side by side. For instance, in the case where the third coaxial terminal 3 from the front side in FIG. 4 is used for transmitting high frequency signals, the radio wave absorbing member 5 may be provided so as to cover at least the third coaxial terminal 3 and the pair of right and left coaxial terminals 3 adjacent to the third coaxial terminal 3.

While the embodiments of the connector according to the present invention have been described, it is to be understood that the present invention is not limited to the embodiments except as defined in the appended claims.

What is claimed is:

1. A connector comprising:

a plurality of coaxial terminals each of which is formed into an L-shape, each of the plurality of coaxial terminals including a connecting part attached to a coaxial cable, and a terminal part bent with respect to the connecting part;

a housing including: (i) a housing body having a plurality of storage parts storing the plurality of coaxial terminals arrayed side by side, and (ii) a cover closing the respective storage parts of the housing body; and a radio wave absorbing member disposed between the plurality of coaxial terminals stored in the respective storage parts and the cover, the radio wave absorbing member extending over the plurality of coaxial terminals, the radio wave absorbing member being disposed so as to face at least: (i) a bent part in which the terminal part is bent with respect to the connecting part of each of the plurality of coaxial terminals, and (ii) an exposed center conductor of each of the coaxial cables, and the radio wave absorbing member is provided in contact with, or in proximity to, each of the plurality of coaxial terminals.

2. The connector according to claim 1, wherein the radio wave absorbing member includes:

a fixing part fixed to an inner surface of the cover; and a plurality of contact pieces extending from the fixing part so as to come into contact with the plurality of coaxial terminals, respectively.

3. The connector according to claim 2, wherein each of the plurality of contact pieces is in contact with a part of one of the plurality of coaxial terminals, the plurality of contact pieces facing the exposed center conductor exposed out of the coaxial cable on which a terminal treatment is performed, each of the plurality of contact pieces being electrically connected to one of the plurality of coaxial terminals.

4. The connector according to claim 1, wherein, in the plurality of storage parts, the storage parts adjacent to each other are partitioned by an insulating partition wall.

* * * * *